US005481765A

United States Patent [19]

Wang

[11] Patent Number: 5,481,765

[45] Date of Patent: Jan. 9, 1996

[54] ADJUSTABLE SHOWER HEAD HOLDER

[76] Inventor: Wen-Mu Wang, No. 32, Lane 266, Fu Te I Rd., Hsi Tze Chen, Taipei Hsien, Taiwan

[21] Appl. No.: 350,071

[22] Filed: Nov. 29, 1994

[51] Int. Cl.[6] ..... A47K 3/22

[52] U.S. Cl. ..... 4/605; 4/567; 4/615

[58] Field of Search ..... 4/567–570, 605, 4/615, 559; 248/75, 220.2, 291; 239/283

[56] References Cited

U.S. PATENT DOCUMENTS

| | | | |
|---|---|---|---|
| 4,964,573 | 10/1990 | Lipski | 4/615 X |
| 5,220,697 | 6/1993 | Birchfield | 4/605 X |
| 5,265,833 | 11/1993 | Heimann et al. | 4/615 X |

FOREIGN PATENT DOCUMENTS

| | | | |
|---|---|---|---|
| 0559997 | 9/1993 | European Pat. Off. | 4/605 |
| 4124352 | 1/1993 | Germany | 4/605 |
| 0328354 | 3/1958 | Switzerland | 4/615 |

*Primary Examiner*—Charles E. Phillips
*Attorney, Agent, or Firm*—Varndell Legal Group

[57] ABSTRACT

An adjustable shower head holder including a mounting block mounted around the hanging rod of a wall mounting rack, a shower head mount coupled to the mounting block by a locating ring and a socket and a pivot to hold a shower head, and an adjustment knob coupled to the mounting block, and a holding down bolt controlled by the adjustment knob to hold the mounting block and the hanging rod together, wherein the holding down bolt can be released from the hanging rod by turning the adjustment knob relative to the mounting block, permitting the shower head to be adjusted in the X-axis and Y-axis directions; the shower head mount can be tunred relative to the mounting block to adjust the position of the shower head in the Y-axis direction.

2 Claims, 7 Drawing Sheets

ADJUSTABLE SHOWER HEAD HOLDER

BACKGROUND AND SUMMARY THE INVENTION

The present invention relates to an adjustable shower head holder which holds a shower head, permitting the position of the shower head to be conveniently adjusted in the X-axis, Y-axis as well as Z-axis directions.

A bath room generally has a shower head holder for hanging the shower head so that the user can take a shower bath without holding the shower head. This shower head holder is commonly fixed to the wall in position. Therefore, when the shower head is hung on the shower head holder, its elevation or angle of inclination can not be changed.

The present invention has been accomplished to provide a shower head holder which eliminates the aforesaid problem. It is one object of the present invention to proivde a shower head holder which permits the position of the shower head to be adjusted in the X-axis, Y-axis and Z-axis directions. It is another object of the present invention to provide a shower head holder which is easy to adjust. According to one aspect of the present invention, the shower head holder comprises a wall mounting rack to hold a hanging rod, a mounting block mounted around the hanging rod of the wall mounting rack, a shower head mount coupled to the mounting block by a locating ring and a socket and a pivot to hold a shower head, and an adjustment knob coupled to the mounting block, and a holding down bolt controlled by the adjustment knob to hold the mounting block and the hanging rod together, wherein the holding down bolt can be released from the hanging rod by turning the adjustment knob relative to the mounting block, permitting the shower head to be adjusted in the X-axis and Y-axis directions; the shower head mount can be turned relative to the mounting block to adjust the position of the shower head in the Y-axis direction. According to another aspect of the present invention, the hanging rod has a plurality of spiral strips raised around the periphery for position engagement with the holding down bolt.

DETAILED DESCRIPTION OF THE PREFERRED EMBODIMENT

Figure 1:
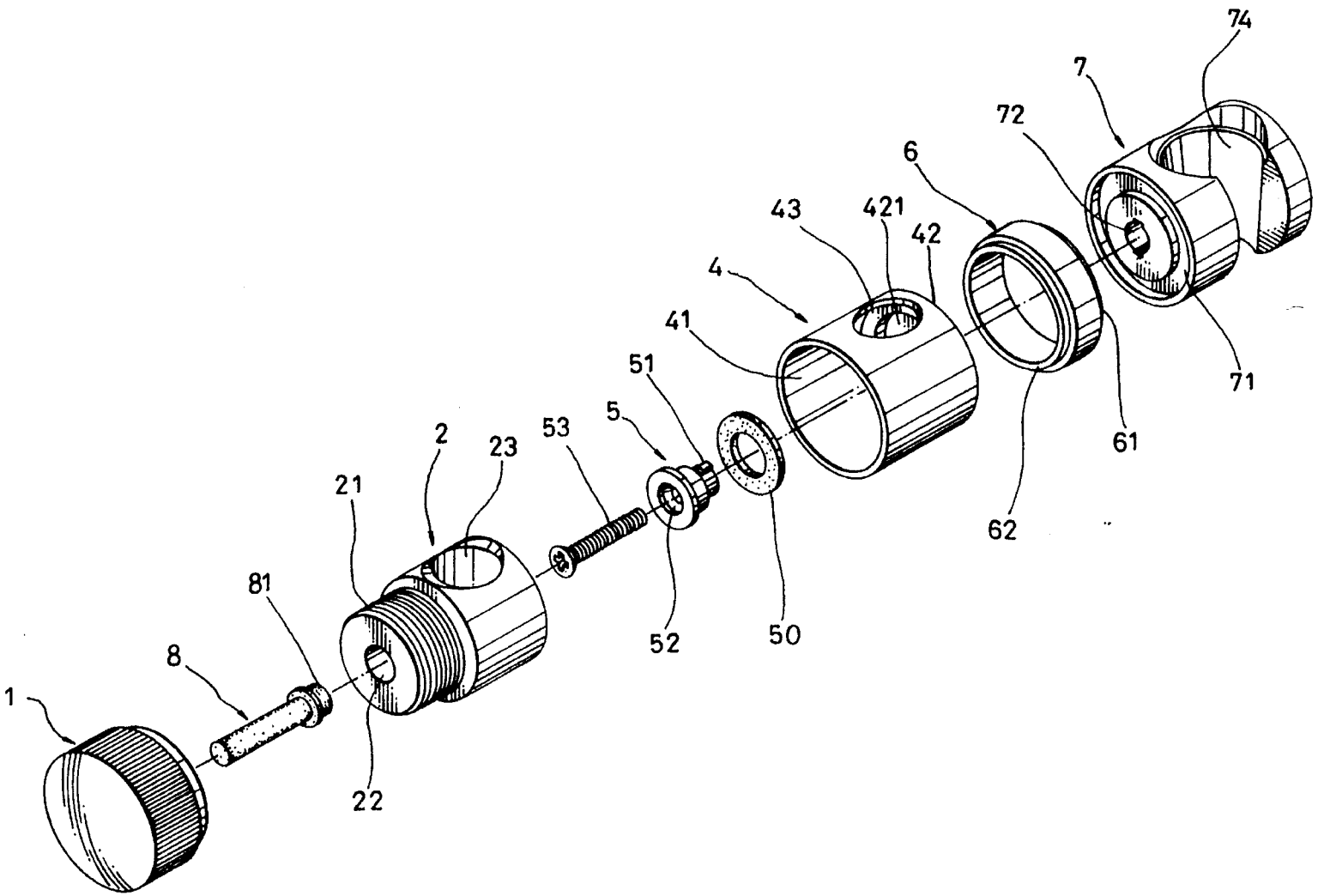
FIG. 1 is an exploded view of a shower head holder according to the present invention (the rack exculded).
Figure 2:
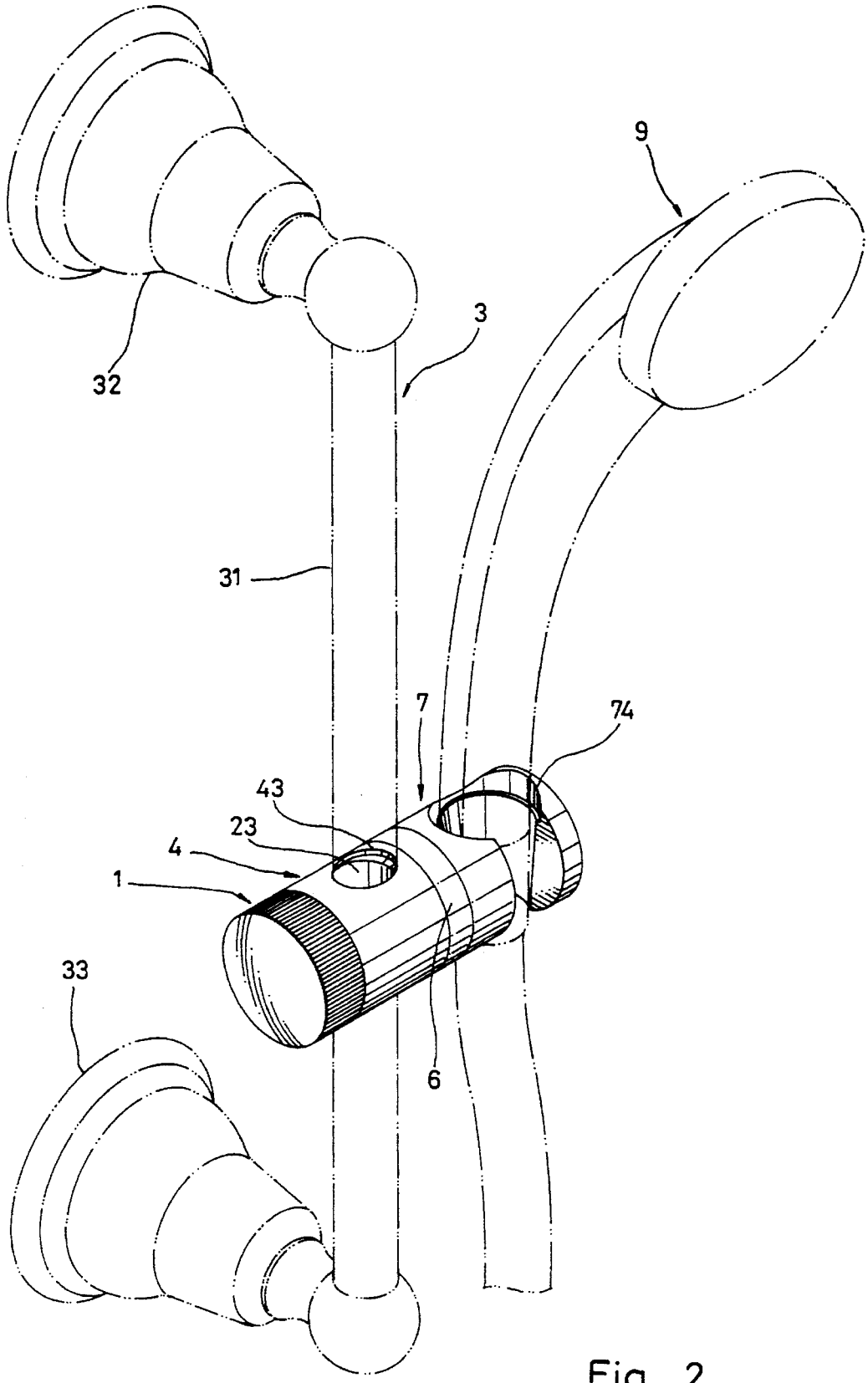
FIG. 2 is an installed view showing the shower head holder of FIG. 1 installed.
Figure 3:
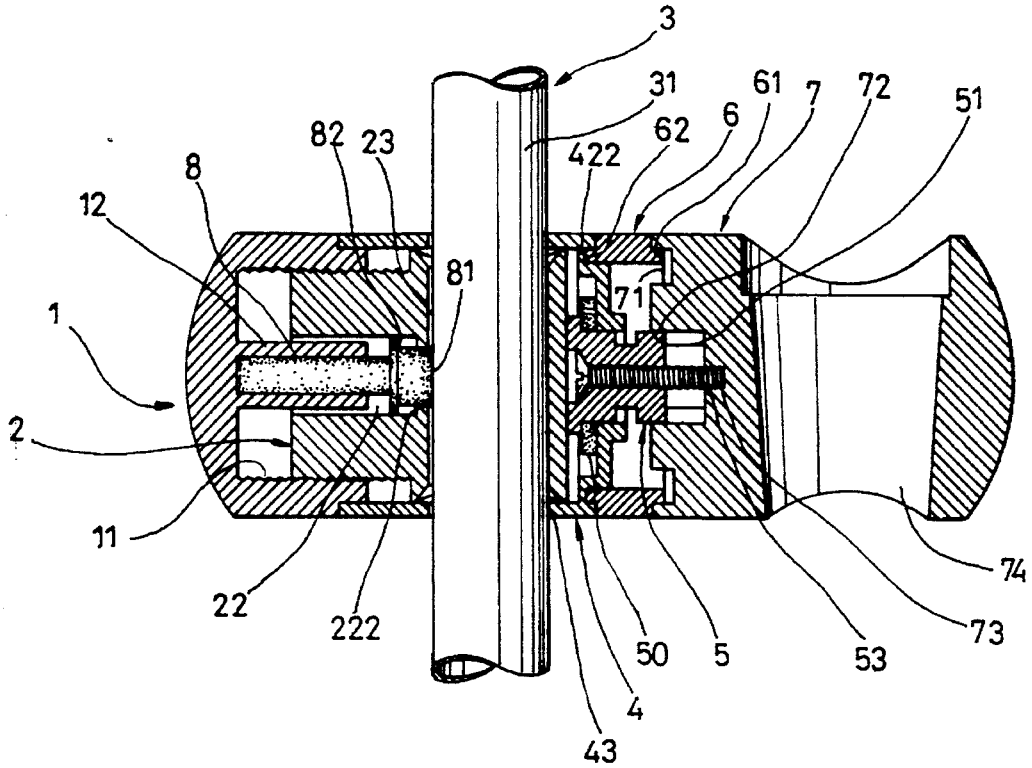
FIG. 3 is an assembly view in section of the shower head holder shown in FIG. 2.
Figure 4:
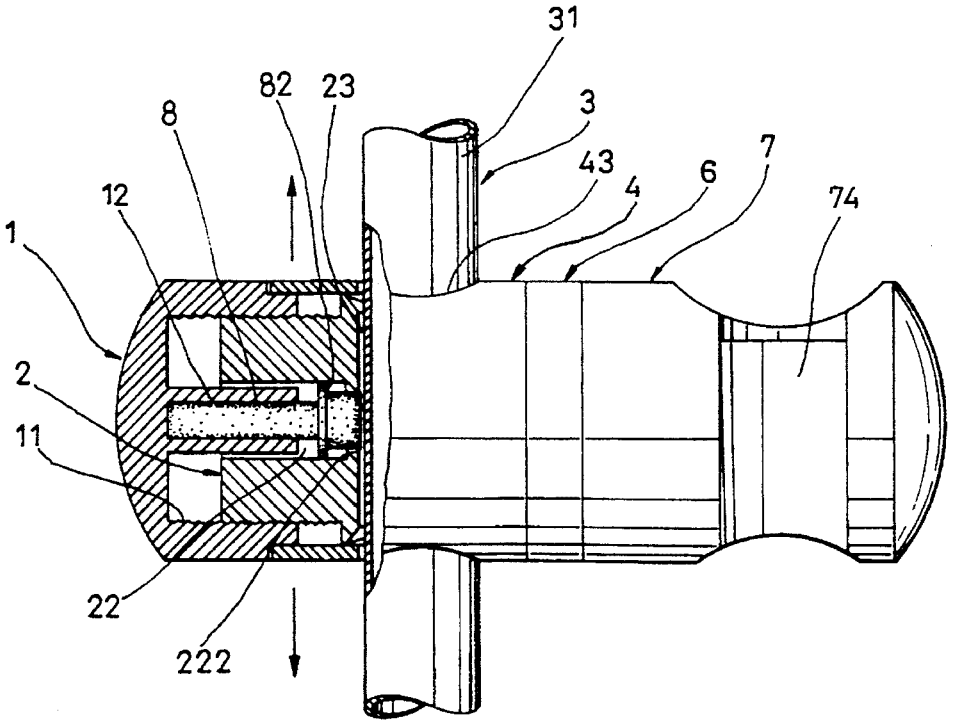
FIG. 4 is another sectional view of the shower head holder shown in FIG. 2.
Figure 5:
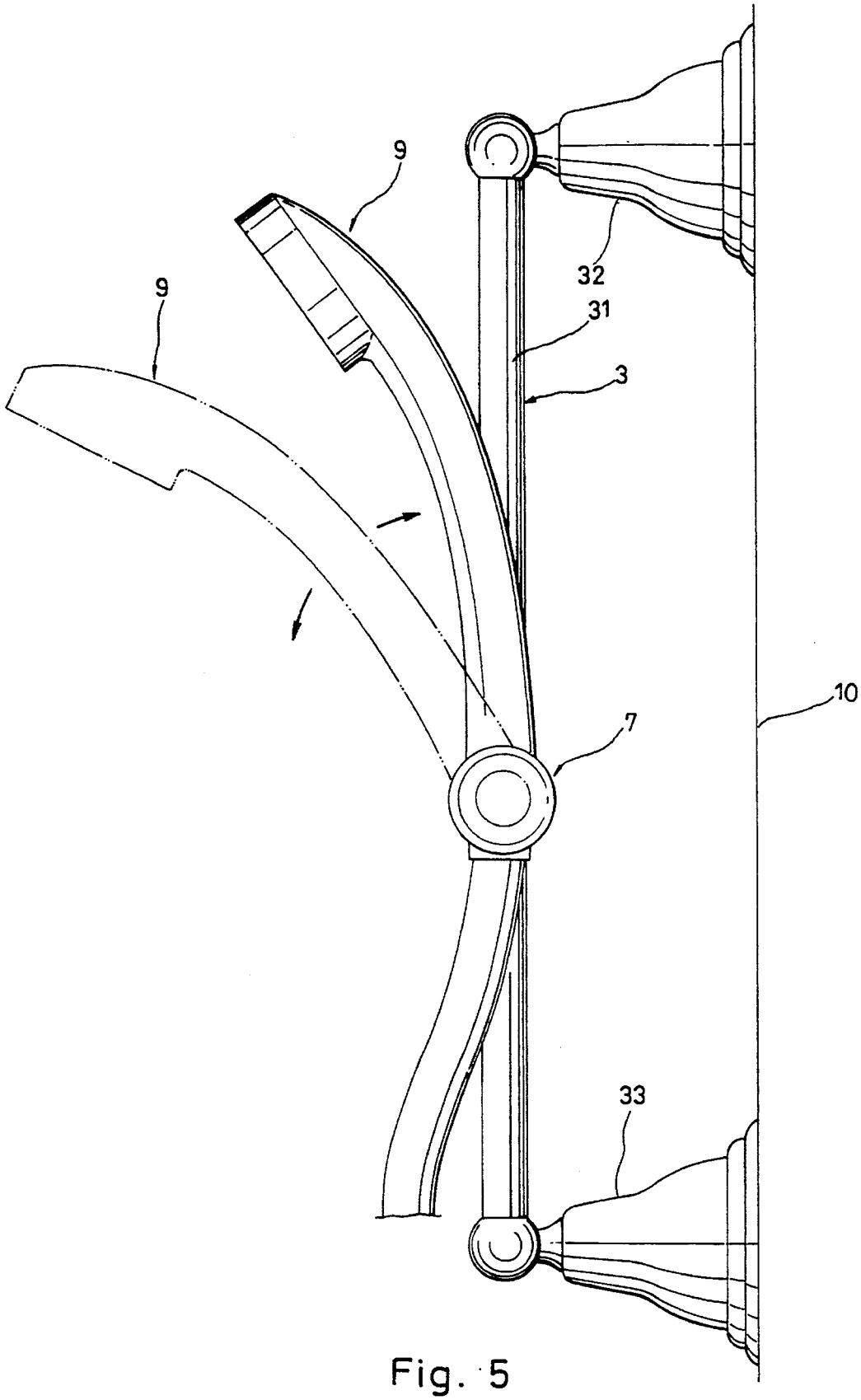
FIG. 5 shows the shower head mount turned relative to the socket to change the angle of inclination of the shower head according to the present invention.
Figure 6:
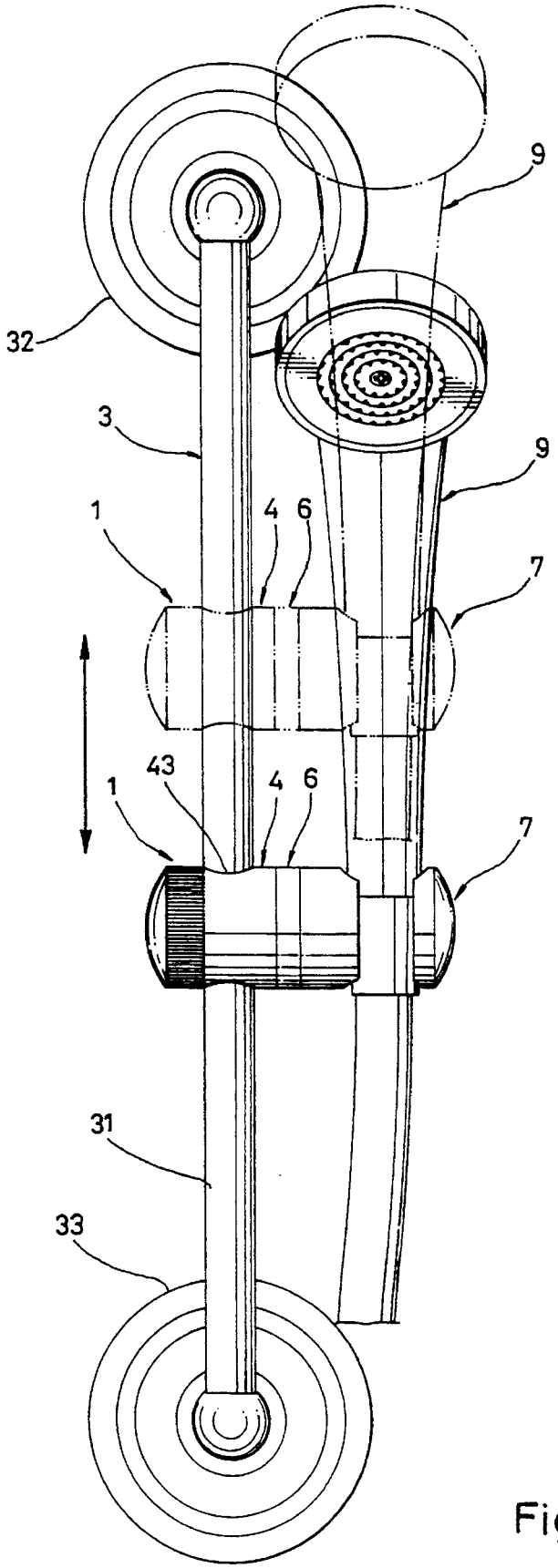
FIG. 6 shows the mounting block moved along the hanging rod to change the position of the shower head relative to the hanging rod according to the present invention.
Figure 7:
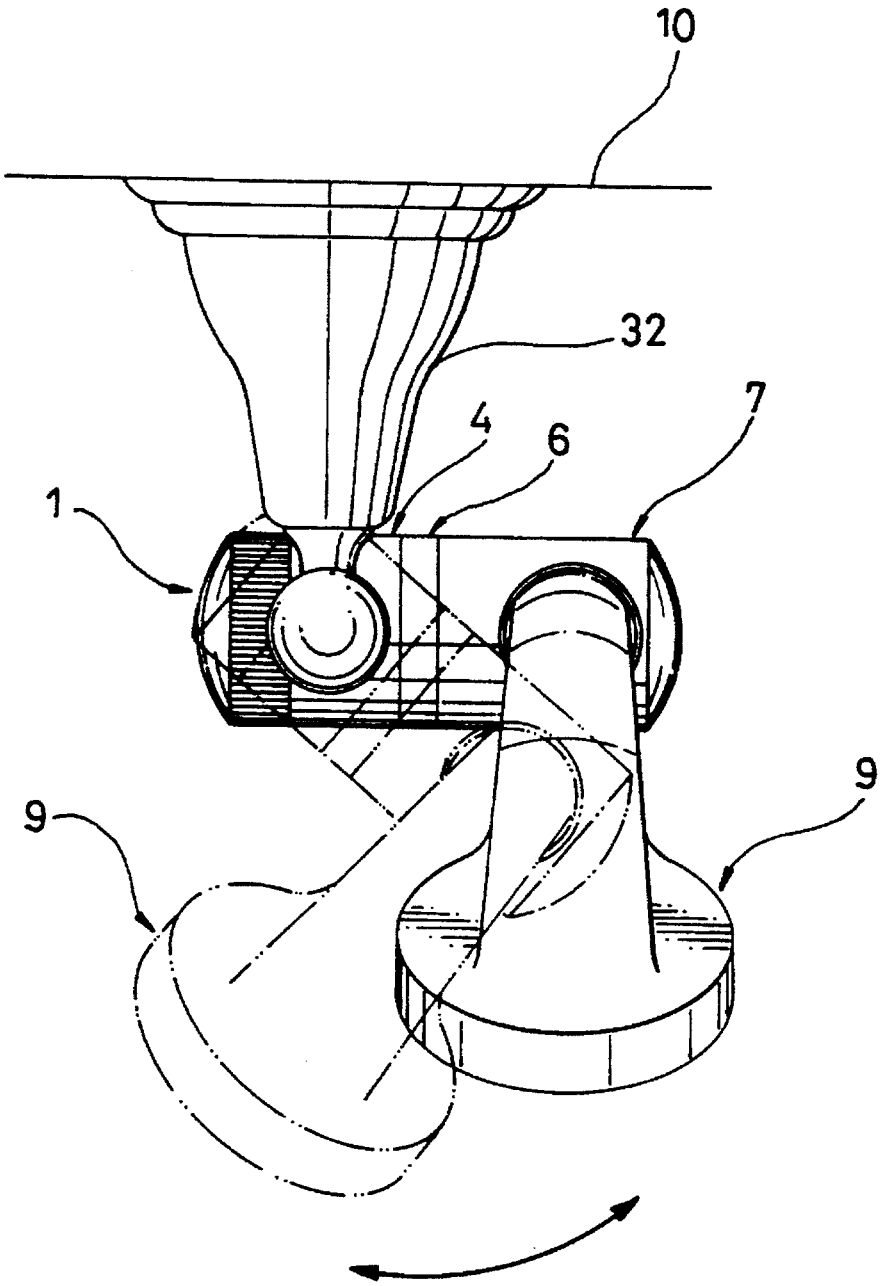
FIG. 7 shows the mounting block turned about the hanging rod to change the positio of the shower head relative to the hanging rod according to the present invention.

Referring to FIGS. 1, 2, 3, and 4, a shower head holder in accordance with the present invention is generally comprised of an adjustment knob 1, a mounting block 2, a rack 3, a socket 4, a headed pivot 5, a friction ring 50, a headed screw 53, a locating ring 6, a shower head mount 7, a holding down bolt 8, and a shower head 9.

The adjustment knob 1 comprises an inside tube 12, which receives the holding down bolt 8, and an inner thread 11 spaced around the inside tube 12. The mounting block 2 comprises a longitudinal center through hole 22, which receives the inside tube 12 and the holding bolt 8, an outer thread 21 around the longitudinal center through hole 22 at one end, which is threaded into the inner thread 11 of the adjustment knob 1, a latitudinal through hole 23 intersecting the longitudinal center through hole 22, and an inside annular flange 222 concentrically disposed inside the longitudinal center through hole 22. The holding down bolt 8 is received in the inside tube 12 of the adjustment knob 1, having a collar 82 disposed between the inside annular flange 222 of the mounting block 2 and the inside tube 12 of the adjustment knob 1, and a front end 81 inserted through the inside annular flange 222 into the latitudinal through hole 23. The socket 4 comprises a longitudinal coupling hole 41 at one end, which receives the mounting block 2, a longitudinal axle hole 421 at an opposite end communicated with the coupling hole 41, an annular groove 42 around the longitudinal axle hole 421, which receives the locating ring 6, a latitudinal through hole 43 intersecting the longitudinal coupling hole 41 and coinciding with the latitudinal through hole 23 of the mounting block 2. The rack 3 comprises two wall mounting blocks 32 and 33 fixedly fastened to the wall 10, and a hanging rod 31 inserted through the latitudinal through hole 43 of the socket 4 and the latitudinal through hole 23 of the mounting block 2 and connected between the wall mounting blocks 32 and 33. The shower head mount 7 is made of cylindrical shape having a screw hole 73 and a coupling hole 72 longitudinally aligned at one end, an annular groove 71 at one end around the coupling hole 72, and a hanging hole 74 latitudinal disposed at an opposite end for hanging the shower head 9. The locating ring 6 comprises a first annular flange 61 at one end fitted into the annular groove 71 on the shower head mount 7, and a second annular flange 62 at an opposite end fitted into the annular groove 42 on the socket 4. The headed pivot 5 is received inside the socket 4 and stopped at one end against the mounting block 2, having a coupling 51 at the other end extended out of the axle hole 421 on the socket 4 and fitted into the coupling 72 on the shower head mount 7 and prohibited from rotary motion relative to the shower head mount 7. The headed pivot containing a longitudinal through hole having a counter sunk hole 52 at the end opposite the coupling. A friction ring 50 is mounted around the headed pivot 5 and stopped inside the socket 4 by a land area surrounding an axial hole 421. The head of screw 53 is inserted through the countersunk hole 52 and threaded into the screw hole 73.

Referring to FIGS. 3 through 7, when the adjustment knob 1 is loosened from the mounting block 2, the front end 81 of the holding down bolt 8 is released from the hanging rod 31, permitting the mounting block 1 to be moved along or be turned around the hanging rod 31 to adjust the position of the shower head 9 relative to the hanging rod 31. When the shower head 9 is moved to the desired position, the adjustment knob 1 is fastened up to fix the mounting block 2 in position. The angle of inclination of the shower head 9 relative to the socket 4 can also be conveniently adjusted by turning the shower head mount 7 relative to the socket 4 and the mounting block 2. Therefore, the position of the shower head 9 can be adjusted in all directions.

Figure 8:
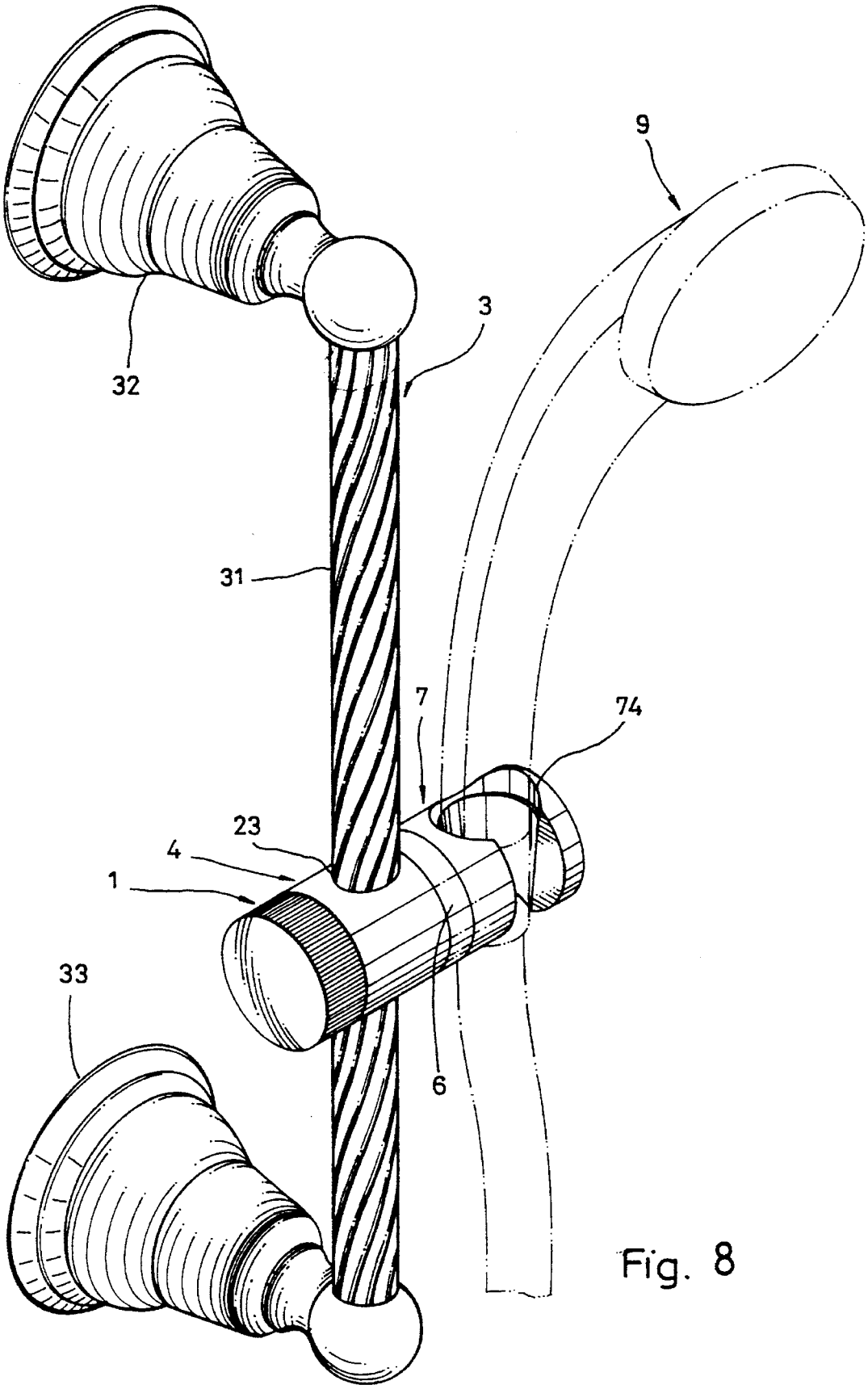
FIG. 8 shows an alternate form of the hanging rod according to the present invention.

Referring to FIG. 8, as an alternate form of the rack 3, the hanging rod 31' has spiral strips 311' raised around the periphery for positive engagement with the front end 81 of the holding down bolt 8.

I claim:

1. An adjustable shower head holder comprising:

a rack having two wall mounting devices fixedly fastened to a wall and a hanging rod connected between said wall mounting devices;

a socket mounted around said hanging rod, said socket comprising a longitudinal coupling hole at one end, a longitudinal axle hole at an opposite end communicated with said longitudinal coupling hole, an annular groove around said longitudinal axle hole, and a latitudinal through hole intersecting said longitudinal coupling hole, which receives said hanging rod;

a mounting block mounted around said hanging rod and received in said socket, said mounting block comprising a longitudinal center through hole, an outer thread around said longitudinal center through hole at one end, a latitudinal through hole intersecting said longitudinal center through hole, which receives said hanging rod, and an inside annular flange concentrically disposed inside said longitudinal center through hole;

an adjustment knob having an inside tube inserted into the longitudinal center through hole of said mounting block, and an inner thread spaced around said inside tube and threaded onto said outer thread of said mounting block;

a holding down bolt received in said inside tube, having a from end inserted through said inside annular flange of said mounting block and forced by said adjustment knob against said hanging rod, said bolt having a collar disposed between said inside tube of said adjustment knob and said inside annular flange of said mounting block;

a shower head mount fastened to said socket for holding a shower head, said shower head mount comprising a screw receiving hole and a coupling hole longitudinally aligned at one end, an annular groove at said one end disposed around the coupling hole of said shower head mount, and a hanging hole latitudinally disposed at an opposite end for hanging a shower head;

a shower head hung on the hanging hole of said shower head mount;

a locating ring coupled between said socket and said shower head mount, said locating ring having a first annular flange at one end fitted into said annular groove on said shower head mount, and a second annular flange at an opposite end fitted into the annular groove on said socket;

a headed pivot received inside said socket and stopped at one end against said mounting block, said headed pivot having a coupling end extended through the axle hole on said socket and fitted into the coupling hole on said shower head mount and prohibited from rotary motion relative to said shower head mount, and having a through hole with a countersunk hole at an end opposite said coupling end;

a friction ring mounted around said headed pivot and stopped inside said socket by a land area surrounding said axle hole of said socket; and a headed screw inserted through the countersunk hole of said headed pivot and threaded into the screw receiving hole on said shower head mount to connect said shower head mount to said socket; and wherein said adjustment knob can be loosened from said mounting block to release said holding down bolt from said hanging rod, permitting said mounting block and said socket to be moved along or turned about said hanging rod to adjust the position of said shower head and said shower head mount can be turned relative to said socket to adjust the position of said shower head.

2. The adjustable shower head holder of claim 1 wherein said hanging rod comprises a plurality of spiral strips raised around the periphery.

* * * * *